US009636914B2

(12) United States Patent
Koide et al.

(10) Patent No.: US 9,636,914 B2
(45) Date of Patent: May 2, 2017

(54) LIQUID EJECTING DEVICE AND METHOD OF MANUFACTURING LIQUID EJECTING DEVICE

(71) Applicant: BROTHER KOGYO KABUSHIKI KAISHA, Nagoya-shi, Aichi-ken (JP)

(72) Inventors: Shohei Koide, Aichi (JP); Atsushi Ito, Aichi (JP); Hikaru Nakamoto, Inuyama (JP); Hiroaki Hiraide, Inazawa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/832,033

(22) Filed: Aug. 21, 2015

(65) Prior Publication Data

US 2016/0052271 A1 Feb. 25, 2016

(30) Foreign Application Priority Data

Aug. 22, 2014 (JP) ..... 2014-169365

(51) Int. Cl.
*B41J 2/14* (2006.01)
*B41J 2/16* (2006.01)
*B41J 2/055* (2006.01)

(52) U.S. Cl.
CPC ..... *B41J 2/1632* (2013.01); *B41J 2/055* (2013.01); *B41J 2/14233* (2013.01); *B41J 2/161* (2013.01);
(Continued)

(58) Field of Classification Search
None
See application file for complete search history.

(56) References Cited

U.S. PATENT DOCUMENTS 6,666,547 B1 * 12/2003 Takahashi ..... B41J 2/14233 347/68
8,413,377 B2 4/2013 Koyama
(Continued)

FOREIGN PATENT DOCUMENTS

JP 2004-255702 A 9/2004
JP 2006-256165 A 9/2006
JP 2007050634 A * 3/2007

OTHER PUBLICATIONS

U.S. Office Action issued in related U.S. Appl. No. 14/832,033, mailed Jan. 25, 2016.
(Continued)

*Primary Examiner* — Erica Lin
(74) *Attorney, Agent, or Firm* — Merchant & Gould P.C.

(57) ABSTRACT

A liquid ejecting device, having a fluid passage structure formed with multiple nozzles arranged in a particular nozzle arrangement direction and multiple passages respectively communicating with the multiple nozzles. The fluid passage structure has a metallic nozzle plate formed with the multiple nozzles which is arranged in a nozzle arrangement direction. Further, the metallic nozzle plate has a liquid ejection surface on which multiple ejection openings respectively corresponding to the multiple nozzles being formed, multiple convex parts protruding from the liquid ejection surface, the multiple convex parts being arranged along the nozzle arrangement direction, beside the multiple ejection openings, respectively. Further, the multiple convex parts are formed by press working applied to the nozzle plate from a side opposite to the liquid ejection surface.

10 Claims, 8 Drawing Sheets

(52) U.S. Cl.
CPC ..... *B41J 2/1623* (2013.01); *B41J 2/1626* (2013.01); *B41J 2/1634* (2013.01); *B41J 2002/14266* (2013.01); *B41J 2002/14419* (2013.01); *B41J 2002/14459* (2013.01)

(56) References Cited

U.S. PATENT DOCUMENTS

| | | | | |
|---|---|---|---|---|
| 2010/0061000 | A1* | 3/2010 | Higuchi ..... | G02B 7/08 359/824 |
| 2010/0245478 | A1 | 9/2010 | Ono | |
| 2011/0057992 | A1 | 3/2011 | Tobita et al. | |
| 2013/0242002 | A1 | 9/2013 | Takahashi et al. | |
| 2013/0342612 | A1 | 12/2013 | Nakakubo | |

OTHER PUBLICATIONS

U.S. Office Action issued in related U.S. Appl. No. 14/826,506, mailed Jan. 25, 2016.
Related U.S. Appl. No. 14/826,506, filed Aug. 14, 2015.
U.S. Office Action (Notice of Allowance) issued in related U.S. Appl. No. 14/826,506, mailed Jul. 13, 2016.

* cited by examiner

SCANNING DIRECTION

SCANNING DIRECTION

SCANNING DIRECTION

LIQUID EJECTING DEVICE AND METHOD OF MANUFACTURING LIQUID EJECTING DEVICE

CROSS-REFERENCE TO RELATED APPLICATION

This application claims priority under 35 U.S.C. §119 from Japanese Patent Applications No. 2014-169365 filed on Aug. 22, 2014. The entire subject matter of the application is incorporated herein by reference.

BACKGROUND

Technical Field

The present disclosures relate to a liquid ejecting device and a method of manufacturing a liquid ejecting device.

Related Art

Conventionally, a liquid ejecting device has been known. An example of such a liquid ejecting device is employed in an inkjet head of an inkjet printer configured to eject ink drops through nozzles formed on the inkjet head. Typically, the inkjet head has a nozzle plate made of synthetic resin (hereinafter, occasionally referred to as plastic) and formed with multiple nozzles, a passage-formed plate made of metal and formed with inflow passages communicating with the multiple nozzles, and piezoelectric elements provided to the passage-formed plate. Such an inkjet head is configured such that the piezoelectric elements apply pressures to ink existing in the ink flow passages to eject the ink drops through the nozzles.

SUMMARY

In the inkjet head as described above, typically, an ink-repellent coat is formed on an ink ejection surface, which is a surface of the nozzle plate and formed with the multiple ink ejection openings, of the plastic nozzle plate at portions surrounding ejection openings of the multiple nozzles in order to prevent the ink resides around the multiple nozzles. Further, according to a conventional inkjet head, two lines of elongated protrusions, which extend in a direction of a nozzle array, are formed on the ink ejection surface of the nozzle plate with each nozzle array arranged therebetween. With the protrusions, when a printing sheet is lifted due to sheet jam or the like during a printing operation, the printing sheet is prevented or suppressed from contacting the ejection openings as it contacts the protrusions. Thus, with this configuration, a peripheral part of each ejection opening or the ink-repellent coat around each ejection opening is prevented from being damaged by the printing sheet.

The conventional nozzle plate as described above is typically manufactured in accordance with a manufacturing process as follows. As a substrate made of synthetic resin which serves as the nozzle plate, a synthetic-resin film made of polyimide or the like is prepared. On one surface of the synthetic-resin film, an ink-repellent agent is applied, and heated-air drying is applied to form the ink-repellent coat. Then, on the synthetic-resin film formed with the ink-repellent coat, multiple nozzles are formed by laser beam machining. Next, the synthetic-resin film formed with the multiple nozzles is bonded with the passage-formed plate formed with passage holes. After bonding, a metal mold is placed on the ink ejection surface of the nozzle plate, on which the ink-repellent coat is formed, and heat-press is applied, the protruded parts are formed on the ink ejection surface.

In the conventional art as described above, the protruded parts are formed on the nozzle plate. Accordingly, the protruded parts are formed of the synthetic-resin. Since the synthetic-resin is low, the protruded parts have low endurance. As the printing sheet repeatedly hits, the protruded parts may be whittled gradually and finally they may be disappear. If the printing sheet hits the protruded parts with a relatively strong force, a part of the protruded part may be chipped.

Further, the protruded parts are typically formed to the plastic substrate, which is to be used as the nozzle plate, by the heat press procedure, due to the heat applied thereto during the heat press procedure, the substrate may warp at the time of the heat press procedure. In order to suppress the degree of the warp, it becomes difficult to apply a relatively large deformation to the substrate, which results in relatively low protruded parts. When the height of the protruded parts is low, the printing sheet may contact the ejection openings easily, and thus, protecting effect of the protruded parts is lowered.

In consideration of the above, according to aspects of the disclosures, an improved liquid ejecting device is provided. With the improved liquid ejecting device, protruded parts are formed in the vicinity of the ejection openings so that portions surrounding the ejection openings can be well protected from being hit by the printing sheet. Further, the protruded parts exhibit high endurance.

According to aspects of the disclosures, there is provided a liquid ejecting device, having a fluid passage structure formed with multiple nozzles arranged in a particular nozzle arrangement direction and multiple passages respectively communicating with the multiple nozzles. The fluid passage structure has a metallic nozzle plate formed with the multiple nozzles which is arranged in a nozzle arrangement direction. Further, the metallic nozzle plate has a liquid ejection surface on which multiple ejection openings respectively corresponding to the multiple nozzles being formed, multiple convex parts protruding from the liquid ejection surface, the multiple convex parts being arranged along the nozzle arrangement direction, beside the multiple ejection openings, respectively. Further, the multiple convex parts are formed by press working applied to the nozzle plate from a side opposite to the liquid ejection surface.

According to aspects of the disclosures, there is provided a method of manufacturing liquid ejecting device having a fluid passage structure formed with multiple nozzles arranged in a particular nozzle arrangement direction and multiple passages respectively communicating with the multiple nozzles. The fluid passage structure has a metallic plate on which the multiple nozzles which is arranged in a nozzle arrangement direction are to be formed. Further, the metallic plate has a liquid ejection surface on which multiple ejection openings respectively corresponding to the multiple nozzles to be formed, and the method includes a convex part forming process of forming multiple convex parts protruding from the liquid ejection surface, the multiple convex parts being arranged along the nozzle arrangement direction, beside the multiple ejection openings, respectively. Further, the multiple convex parts are formed by press working applied to the metallic plate from a side opposite to the liquid ejection surface.

BRIEF DESCRIPTION OF THE ACCOMPANYING DRAWINGS

FIG. 1 schematically shows a plan view of an inkjet printer according to aspects of an illustrative embodiment of the disclosures.

DETAILED DESCRIPTION OF THE EMBODIMENTS

Referring to the accompanying drawings, an illustrative embodiment and its modifications will be described. In the embodiments, an invention of a liquid ejecting device will be applied to an inkjet head.

Figure 1:
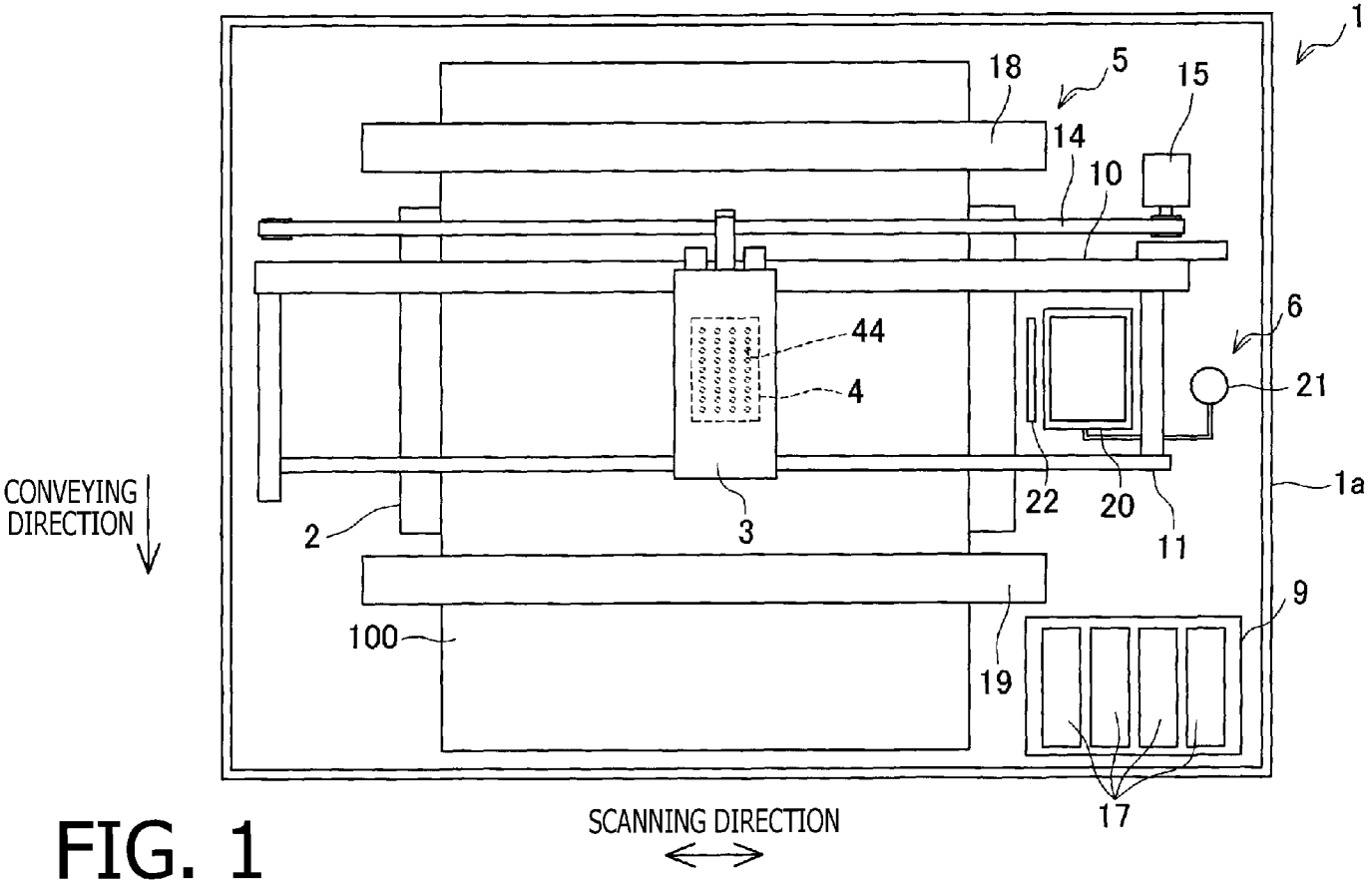

FIG. 1 schematically shows a plan view of an inkjet printer 1 according to an illustrative embodiment of the disclosures. In the following description, directions with respect to the inkjet printer 1 are defined such that a direction closer with respect to plane of FIG. 1 is an upper direction of the inkjet printer 1, while a direction farther with respect to the plane of FIG. 1 is a lower direction of the inkjet printer 1, the description will be made using the "upper" and "lower" directions with respect to the inkjet printer 1.

As shown in FIG. 1, the inkjet printer 1 has a platen 2, a carriage 3, an inkjet head 4, a conveying mechanism 5, and a maintenance mechanism 6.

A printing sheet 100 on which an image will be printed is to be placed on an upper surface of the platen 2. The carriage 3 is configured to reciprocally move along a pair of guide rails 10 and 11, in a scanning direction, within an range in which the carriage 3 faces the platen 2. The carriage 3 is connected with an endless belt 14. When a carriage drive motor 15 moves the endless belt 14, the carriage 3 moves in the scanning direction. Such a configuration is well-known, and will not be described in detail anymore.

The inkjet head 4 is attached to the carriage 3 and is movable, together with the carriage 3, in the scanning direction. On a lower surface, which is a farther side with respect to the plane of FIG. 1, of the inkjet head 4, multiple nozzles 44 are formed. Further, as shown in FIG. 1, a holder 9 is provided to a main body 1*a* of the inkjet printer 1. The holder 4 is configured to hold four ink cartridges 17 respectively storing ink of four colors (e.g., black, yellow, cyan and magenta). The four colors of ink respectively stored in the four ink cartridges 17 is supplied to the inkjet head 4 through tubes. Since such a structure is well-known, detailed description if illustration will not be provided for brevity. The inkjet head 3, together with the carriage 3, moves in the scanning direction, and ejects ink drops of four colors onto the printing sheet placed on the platen 2.

The conveying mechanism 5 has two conveying rollers 18 and 19, which are arranged on opposite sides, in a conveying direction, with respect to the platen 2 such that the conveying rollers 18 and 19 sandwich the platen 2 therebetween in the conveying direction. The conveying mechanism 5 conveys the printing sheet 100 placed on the platen 2 with the two conveying rollers 18 and 19.

As movement of the inkjet head 4 in the scanning direction and ejection of the ink drops from the multiple nozzles 44, and conveying of the printing sheet 100 in the conveying direction by a particular amount with use of the conveying rollers 18 and 19 are executed alternately, an image and/or characters are printed on the printing sheet 100.

The maintenance mechanism 6 is arranged on a right side with respect to the platen within a movable range of the carriage 3 in the scanning direction. The maintenance mechanism 6 has a cap 20, a suction pump 21 connected to the cap 20, and a wiper 22.

The cap 20 is configured to move in the up-down direction (i.e., in a direction orthogonal to the plane of FIG. 1). When the cap 20 moves upward when the carriage 3 is located to face the cap 20, the cap closely contacts the lower surface of the inkjet head 4 to cover the multiple nozzles 44. In this state, a suction purge is executed, that is, by reducing the pressure inside the cap 20 with use of the suction pump 21, ink is forcibly discharged from the multiple nozzles 44. As the suction purge is executed, dust particles, bubbles and/or viscosity-increased ink due to drying are forcibly discharged from the multiple nozzles 44, discharge failure of the nozzles 44 due to the dust particles, bubbles and the like can be prevented.

The wiper 22 is a thin plate member made of elastic material such as rubber, and arranged next to the cap 20 in the scanning direction. Immediately after the suction purge is executed, ink is adhered on the lower surface of the inkjet head. According to the illustrative embodiment, after the suction purge is executed, the carriage 3 is moved in the scanning direction with the cap 20 spaced from the lower surface of the inkjet head 4. During this movement of the inkjet head 4, the wiper 22 keeps contacting the lower surface of the inkjet head 4 and moves relative to the loser surface of the inkjet head 4 so that the ink adhered onto the lower surface of the inkjet head 4 is wiped off.

Figure 2:
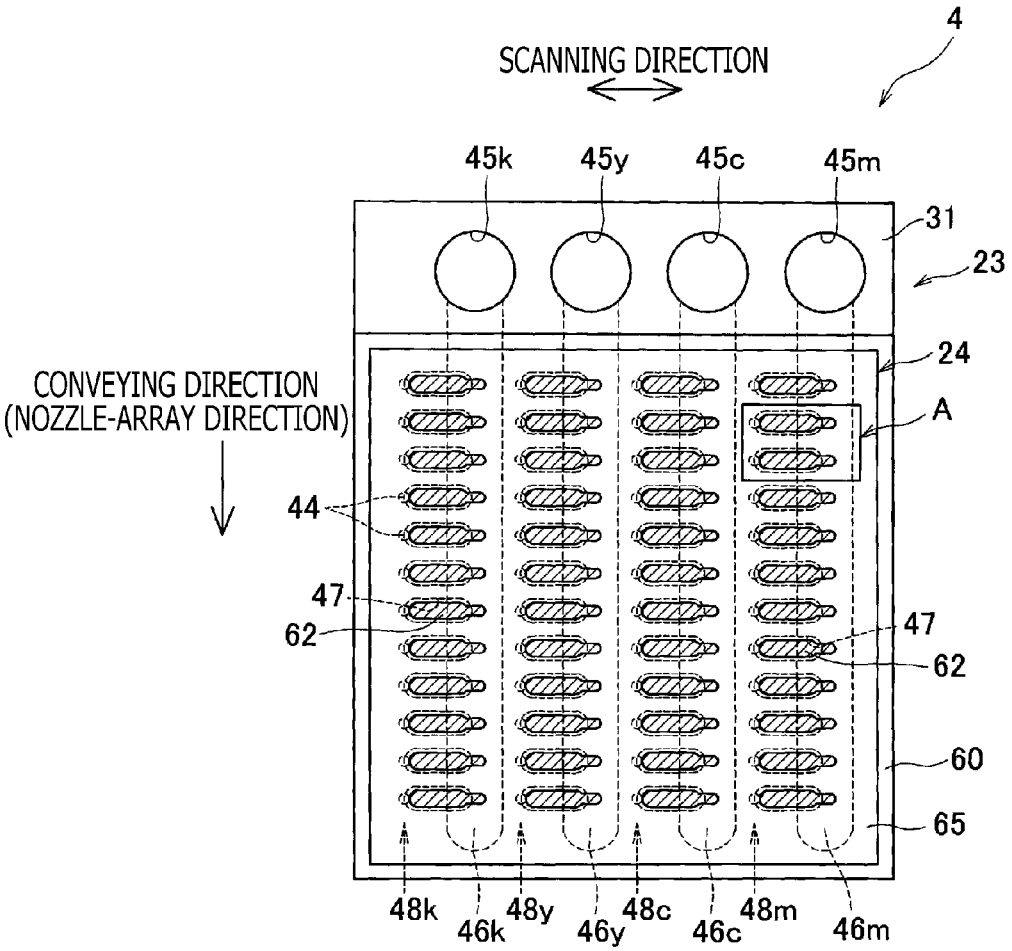
FIG. 2 is a top view of the inkjet printer according to aspects of the illustrative embodiment of the disclosures.
Figure 3:
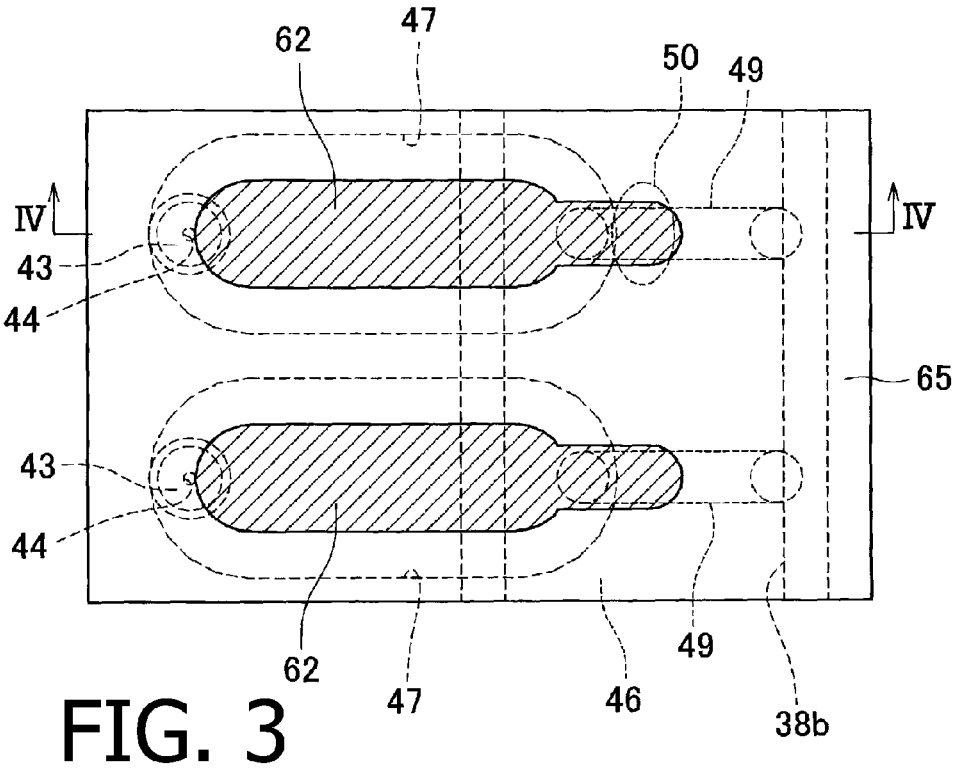
FIG. 3 is an enlarged view of a part of FIG. 2.
Figure 4:
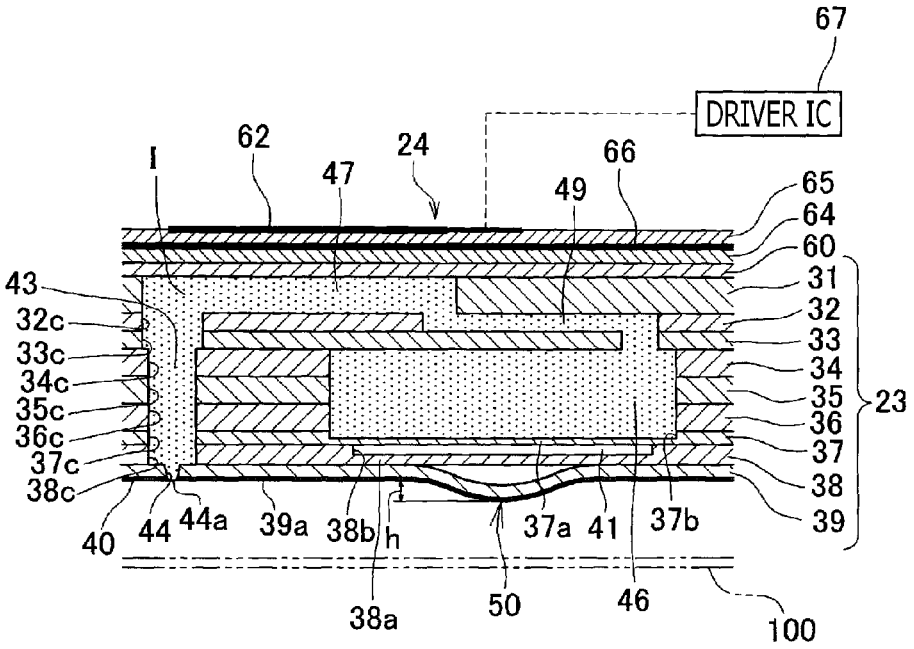
FIG. 4 is a cross-sectional view of the inkjet head taken along ling IV-IV in FIG. 3, according to aspects of the illustrative embodiment of the disclosures.

As shown in FIGS. 2-4, the inkjet head 4 has a passage unit 23, and a piezoelectric actuator 24. It is noted that FIG. 4 shows a state where the ink I is filled in an ink flow passage formed inside the passage unit 23.

Passage Unit

As shown in FIG. 4, the passage unit 23 has a laminated structure of having multiple laminated plates 31-39. Each of the multiple plates 31-39 is a plate made of metallic material such as stainless steel. According to the illustrative embodiment, each of the multiple plates 31-39 is formed such that a sheet-like rolled material formed by rolling to have a particular thickness is carved up into pieces having particular sizes. The multiple plates 31-39 are bonded with adhesive agent in the laminated state.

The lowermost plate 39 is a nozzle plate on which the multiple nozzles 44 are formed. Each of the nozzles 44 is a through-opening piercing through the plate 39, the through-opening has a tapered cylindrical shape of which a lower side (i.e., an ink ejection side) has a smaller diameter. In the following description, the lower surface of the nozzle plate 39 on which the ejection openings 44*a* are formed will occasionally be referred to as an ink ejection surface 39*a* (see FIG. 4).

The multiple nozzles 44 are arranged in four lines, each line extending in the conveying direction, and the four lines are arranged in the scanning direction. In the following description, the each line of the nozzles 44 will be referred to a nozzle array. As shown in FIG. 4, the four lines of the nozzles 44 constitute four nozzle arrays 48*k*, 48*y*, 48*c* and 48*m* which are configured to eject ink drops of black, yellow, cyan and magenta, respectively. Each of or all of the nozzle arrays 48*k*, 48*y*, 48*c* and 48*m* will occasionally be referred to simply by a term "nozzle array 48" collectively.

The ink ejection surface 39*a* of the nozzle plate 39 is covered with a liquid-repellent coat 40 made of fluorine resin such as PTFE (polytetrafluoroethylene). As the liquid-repellent coat 40 covers the ink ejection surface 39*a* at a surrounding area of each of the ejection openings 44*a*, the ink ejected by the nozzles 44 are prevented from residing on portions surrounding the ink ejection openings 44. It is noted that, although the liquid-repellent coat 50 is formed on an entire area of the lower surface of the nozzle plate 39, such a configuration can be modified so that only surrounding areas of the ejection openings 44*a* of the ink ejection surface 39*a* are covered with the liquid-repellent coat 40.

On the plates 31-38 except for the nozzle plate 39, the ink flow passages including manifolds 46 and pressure chambers 47 (described below) are formed.

As shown in FIG. 2, on the uppermost plate 31 which serves as an top surface of the passage unit 23, four ink supply holes 45*k*, 45*y*, 45*c* and 45*m* are formed along the scanning direction. In the following description, each of or all of the four ink supply holes 45*k*, 45*y*, 45*c* and 45*m* will occasionally be referred to collectively as ink supply holes 45. To the four ink supply holes 45 (45*k*, 45*y*, 45*c* and 45*m*), the ink of four colors (i.e., black, yellow, cyan and magenta) is supplied from the ink cartridges 17 (see FIG. 1) held in the holder 9, respectively.

Further, on the fourth to seventh plates 34-47 from the top, four manifolds 46*k*, 46*y*, 46*c* and 46*m* are formed. It is noted that each of or all of the four manifolds 46*k*, 46*y*, 46*c* and 46*m* will occasionally be referred to collectively as manifolds 46. According to the illustrative embodiment, each manifold 46 is formed through the four laminated plates 34-37. The four ink supply holes 45 are connected to the four manifolds 46, respectively, through communication holes (not shown) formed on the plates 32 and 33.

On the lowermost plate 37 of the four plates 34-37 forming the manifolds 46, four concave parts 37*b* extending along the four manifolds 46 are formed by half etching, at portions serving as a bottom wall parts 37*a* that partition the four manifolds 46 as shown in FIG. 4. Because of this configuration, the thickness of the plate 37 around the bottom wall parts 37*a* are smaller than the other parts of the plate 37.

Further, on an upper surface of the plate 38 which is located immediately below the plate 37, concave parts 38*b* are formed by half etching at portions facing the bottom wall parts 37*a*. The portions of the plate 38 facing the bottom wall parts 37*a* are formed to be thin-walled parts 38*a* having smaller thickness than the other parts of the plate 38. Furthermore, spaces 41 are formed between the bottom wall parts 37*a* of the manifolds 46 formed on the plate 37 and the thin-walled parts 38*a* formed below the bottom wall parts 37*a*, respectively. With this configuration, in accordance with pressure change inside the manifolds 46, the bottom wall parts 37*a* easily deform so that the pressure changes inside the manifolds 46 are reduced by deformation of the bottom wall parts 37*a*.

On the uppermost plate 31, multiple pressure chambers 44 respectively corresponding to the multiple nozzles 44 are formed. The multiple pressure chambers 47 are arranged to have four lines corresponding to the four manifolds 46. The multiple pressure chambers 47 are covered with a vibration plate 60 of the piezoelectric actuator 24. As shown in FIGS. 3 and 4, each pressure chamber 47 has an elongated shape which is longer in the scanning direction. Further, a left end part of each pressure chamber 47 overlaps the corresponding nozzle 44 and a right end part of each pressure chamber 48 overlaps the corresponding manifold 46, when viewed from the above.

As shown in FIGS. 3 and 4, on the plate 32 which is the second plate from the top of the passage unit 23, multiple throttle passages 49 connecting the manifolds 46 and the multiple pressure chambers 47 are formed. Further, on the seven plates 32-38 between the uppermost plate 31 and the lowermost plate 39 of the passage unit 23, individual passage holes 32*c*-38*c* constituting communication passages 43 connecting the pressure chambers 37 and the nozzles 44 are formed.

The plates 31-39 described above are laminated and bonded to constitute the passage unit 23. Inside the passage unit 23, from one manifold 46, multiple individual passages are diverged to reach the multiple nozzles 44 via the throttle passage 49, the pressure chamber 47 and the communication passages 43.

In a conventional inkjet head, there could be a situation where the printing sheet being conveyed in the conveying direction contacts the ink ejection surface of the inkjet head when the printing sheet is jammed or conveyed as it is in a bent state. In such a case, an end part of the ejection opening or a surrounding area of the ejection opening may be scratched by the printing sheet, which may cause an ejection failure in an ink ejection direction or the like. In particular, when the ink ejection surface is covered with the liquid-repellent coat, scratching of the liquid-repellent coat around the ink ejection opening may lower liquid-repellency, which may result in residual ink around the ink ejection opening and ejection failure of the ink drops.

Figure 5:
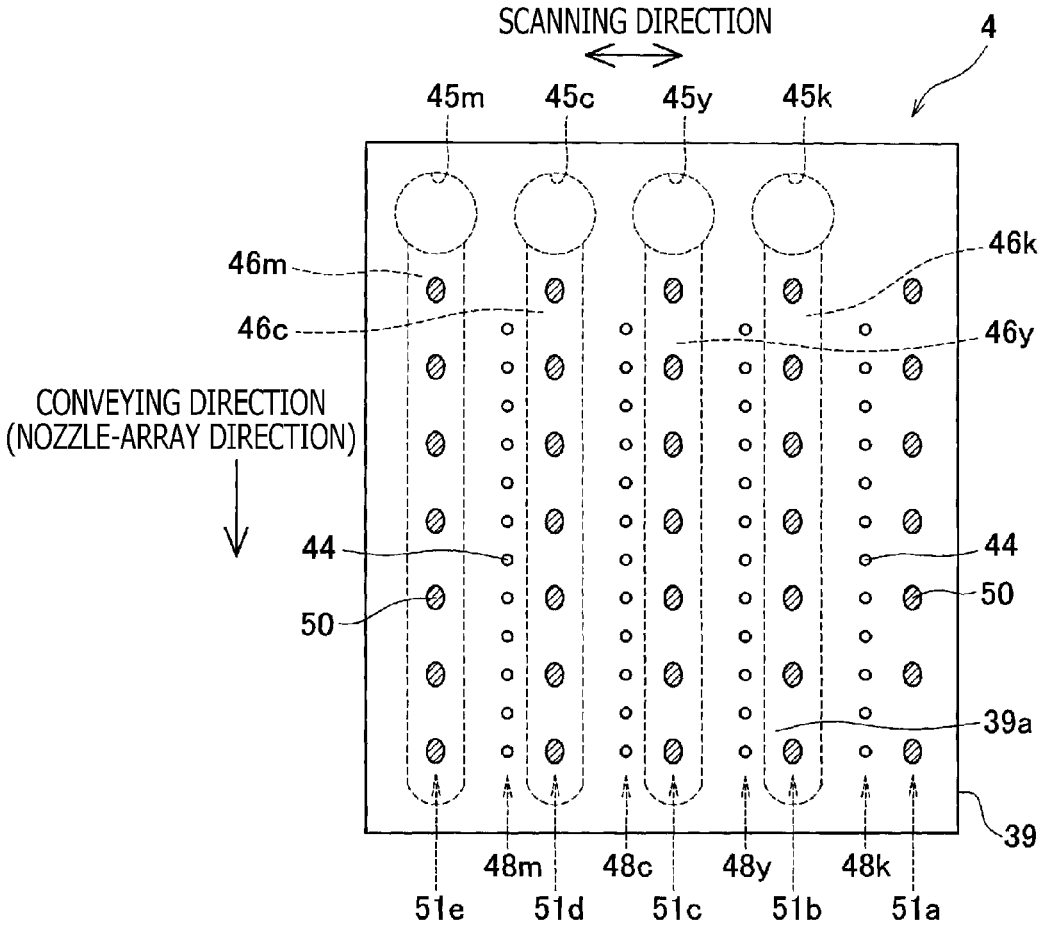
FIG. 5 is a bottom view of an inkjet head according to aspects of the illustrative embodiment of the disclosures.

According to the illustrative embodiment, multiple convex parts 50 are formed on the ink ejection surface 39*a*, as shown in FIGS. 3-5, to prevent the printing sheet 100 from contacting the surrounding areas of the ejection openings 44*a*.

As shown in FIGS. 3-5, multiple lines of convex parts 50 are arranged on the ink ejection surface 39*a* of the nozzle plate 39. According to the illustrative embodiment, there are five lines (51*a*-51*e*) of convex parts 50, and in each of the lines 51*a*-51*e*, multiple convex parts 50 are arranged in the conveying direction. In the following description, each of the lines 51*a*-51*e* of the convex parts 50 will occasionally be referred by a representative numeral 51.

As described above, on the nozzle plate 39, the four nozzle arrays 48 (48*k*, 48*y*, 48*c* and 48*m*) respectively configured to eject black, yellow, cyan and magenta ink are arranged in the scanning direction. Then, as shown in FIG. 5, the five lines 51 (51*a*-51*e*) of convex parts are arranged next to the four nozzle arrays 48 in the scanning direction. It is noted that, in FIG. 5, five lines 51, each of which extends in the conveying direction, are arranged in the scanning direction. Therefore, it could be said that the convex parts 50 are arranged in both the conveying direction and the scanning direction. In such a view, however, the number of arrangement of the convex parts 50 in the conveying direction is larger than that in the scanning direction.

On both sides, in the scanning direction, of the nozzle array 48*k*, two lines 51*a* and 51*b* of the convex parts 50 are arranged so that the two lines 51*a* and 51*b* sandwiches the nozzle array 48*k*. The three lines 51*b*, 51*c* and 51*d* of the convex parts 50 are arranged between each two of the four nozzle arrays 48 (48*k*, 48*y*, 48*c* and 48*m*). With this arrangement, each of the four nozzle arrays 48 (48*k*, 48*y*, 48*c* and 48*m*) is sandwiched, in the scanning direction, by two lines 51 of the convex parts 50.

As described above, the multiple convex parts 50 are arranged along the nozzle arrangement direction (i.e., the conveying direction), and next, in the scanning direction, to the multiple nozzles 44. Further, each nozzle array 48 is sandwiched between two lines 51 of the convex parts 50 arranged at closer positions in the scanning direction. With this configuration, regardless whether the carriage 3 moves leftward or rightward, the printing sheet 100 will not contact the surrounding areas of the nozzles 44 so easily. Thus, it is ensured that the surrounding area of the ejection opening 44*a* of each nozzle 44 is protected by the convex parts 50 arranged closer to the ejection opening 44*a*, and the liquid-repellent coat 40 is prevented from being scratched or damaged.

As shown in FIGS. 3 and 5, each convex part 50 has an oval shape elongated in the conveying direction (i.e., in the nozzle arrangement direction) when viewed from the above. Further, an apex part of each convex part 50 has a rounded shape. Accordingly, even if the printing sheet 100 hits the convex part 50, the printing sheet 100 may not be damaged. Further, because of the above shape, when the ink adhered onto the ink ejection surface 39*a* is wiped by the wiper 22, the wiper 22 may not be caught by the convex parts 50, and the wiper 22 can easily climb over the convex parts 50.

As is know from FIG. 4, each convex part 50 is formed such that a part of the nozzle plate 39 (i.e., the metallic plate) is deformed to downwardly protrude. Further, each convex part 50 is formed by a press working. It is noted that, in order to ensure that the printing sheet 100 is prevented from contacting the surrounding areas of the nozzles 44 on the ink ejection surface 39*a*, it is preferable that the height (i.e., a protruded amount with respect to the ink ejection surface 39*a*) of the convex part 50 is large to the certain extent. For example, the height h of the convex part 50 is approximately 100 μm.

As described above, the convex parts 50 which protrude from the ink ejection surface 39*a* are formed by deforming parts of the nozzle plate 39 which is made of metallic material. As the convex parts 50 are formed by the metallic material, strength of each convex parts 50 is high, and the convex parts 50 are excellent in durability. That is, even if the printing sheet 100 hits the convex part 50, the convex part 50 will not be lost as whittled or hipped by the printing sheet 100.

Piezoelectric Actuator

As shown in FIGS. 2-4, the piezoelectric actuator 24 has the vibration plate 60, piezoelectric layers 64 and 65, multiple individual electrodes 62, and a common electrode 66. The vibration plate 60 is boded on the upper surface of the passage unit 23 with covering the multiple pressure chambers 47. The two piezoelectric layers 64 and 65 are laminated on the upper surface of the vibration plate 60. The multiple individual electrodes 62 are arranged on the upper surface of the upper piezoelectric layer 65 so as to face the multiple pressure chambers 47, respectively. The common electrode 66 is arranged between the two piezoelectric layers 64 and 65 so as to span across the multiple pressure chambers 47.

The multiple individual electrodes 62 are respectively connected to driver ICs (integrated circuits) 67, which are configured to control the piezoelectric actuator 24. The common electrode 66 is always kept to have a grounded electric potential. Further, portions of the upper piezoelectric layer 65 sandwiched between the individual electrodes 62 and the common electrode 66 are polarized in its thickness direction, respectively.

An operation of the piezoelectric actuator 24 when the ink drops are ejected from the nozzles 44 will be described. When a drive signal is applied from the driver IC 67 to a certain individual electrode 62, a potential difference is generated between the individual electrode 66 and the common electrode which is maintained to have the ground potential. Then, in a portion of the piezoelectric layer 65 at a portion sandwiched by the individual electrode 62 and the common electrode 66, an electrical field is generated in its thickness direction.

Since the polarization direction of the piezoelectric layer 65 and the direction of the electric field coincide with each other, the piezoelectric layer 65 extend in the thickness direction, which is the polarization direction, and shrinks in a surface direction. In association with this deformation (i.e., extension and shrink) of the piezoelectric layer 65, a portion of the vibration plate 60 facing the pressure chamber 47 warps to protrude toward the pressure chamber 47. At this stage, a capacity of the pressure chamber 47 is reduced and a pressure is applied to the ink inside the pressure chamber 47, thereby an ink drop is ejected through the nozzle 44 communicating with the pressure chamber 47.

Next, a method of manufacturing the inkjet head 4 described above will be described centering on a manufacturing process of the passage unit 23.

Passage Unit Manufacturing Process

Firstly, on the metallic plates constituting the passage unit 23 except for the nozzle plate 39 (i.e., the plates 31-38), openings and holes constituting parts of the ink flow passages such as the pressure chambers 47, the manifolds 46 and individual passage holes 32*c*-38*c* are formed by etching.

Nozzle Forming Process

Figure 6A:
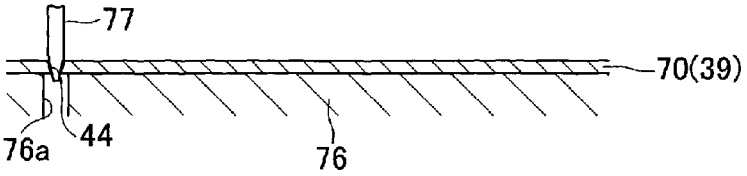
FIGS. 6A-6F illustrate a manufacturing process of the inkjet head according to aspects of the illustrative embodiment of the disclosures.

Next, as shown in FIG. 6A, multiple nozzles 44 are formed on a metallic plate 70 which will serve as the nozzle plate 39. As methods of forming the multiple nozzles 44 on the metallic plate 70, piercing by pressing, laser machining and the like are known. When the press-piercing is employed, the metallic plate 70 is placed on a die 76 formed with multiple cut holes 76*a*. Then, a punch 77 is press-contacted onto each of portions of the upper surface of the metallic plate 70 covering the cut holes 76*a*, and make the punch 77 proceed through the metallic plate 70, each of the multiple nozzles 44 is formed. When the nozzles 44 are formed by press-piercing, burrs are formed at periphery of each ejection opening 44*a* on the ink ejection surface 39*a* of the nozzle plate 39 (i.e., the metallic plate 70), the lower surface of the nozzle plate 39 is to be grinded.

Liquid-Repellent Coat Forming Process

Figure 6B:
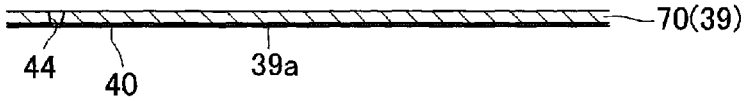

Next, as shown in FIG. 6B, the liquid-repellent coat 40 is formed on the ink ejection surface 39*a* of the nozzle plate 39 on which the multiple nozzles 44 have been formed. The liquid-repellent coat 40 may be formed by adhering a fluorine resin film on the nozzle plate 39, or by applying fluorine resin liquid on the nozzle plate 39.

Protective Film Adhering Process

Figure 6C:
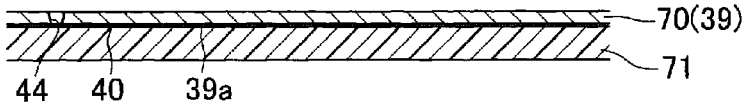

Next, as shown in FIG. 6C, a protective film 71 made of synthetic resin film for protecting the liquid-repellent coat 40 is adhered on the ink ejection surface 39*a* of the nozzle plate 39. The protective film 71 is, for example, adhered on the nozzle plate 39 using a UV (ultraviolet) releasable adhesive agent.

Convex Part Forming Process

Figure 6D:
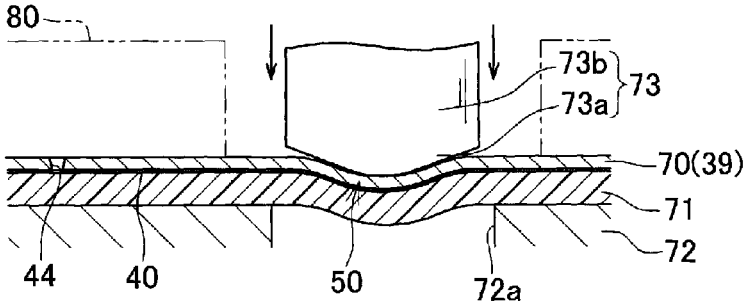

Next, as shown in FIG. 6D, the multiple convex parts 50 are formed by applying press working to the nozzle plate 39. For example, the nozzle plate 39 covered with the protective film 71 is placed on the die 72 having the multiple cut holes 72*a*. Next, by pushing a tip of a punch 73 into the nozzle plate 39 at a position corresponding to each of the cut holes 72*a* of the die 72 from the side opposite to the ink ejection surface 39*a* to apply the press working to cause plastic deformation to the metallic nozzle plate 39. With the above process, the multiple convex parts 50, which protrude downward from the ink ejection surface 39*a* and aligned along lines which are parallel with the multiple nozzle arrays, are formed. It is noted that, during the above press working, the lower surface of the nozzle plate 39 is protected by the protective film 71 and does not contact the die 72. Therefore, the liquid-repellent coat 40 formed on the nozzle plate 39 is protected from being damaged.

As shown in FIG. 6D, the punch 73 has a substantially cylindrical shape formed with the tapered part 73*a* of which diameter is smaller toward the end side. When the punch 73 is press-contacted onto the nozzle plate 39, it is preferable that only the tapered part 73*a* is pushed in while a straight part, of which the diameter remains unchanged, is not pushed in. By press-contacting the punch 73 in such a way, shear deformation occurred to the nozzle plate 39 can be made smaller and rupture of the nozzle plate 39 can be prevented. Further, by inserting only the tapered part 73*a* of the punch 73, friction between the punch 73 and the nozzle plate 39 remains relatively small, it is unnecessary to use processing oil. Accordingly, after the press working, a washing process to wash out the processing oil adhered on the nozzle plate 39 is unnecessary.

In a general press working, a stripper is provided to a surface of a work on which the punch is press-contacted in order to ensure that the punch is removed from the work after the press working and/or to prevent the warp of the work. When a foreign body is engaged between the work and the stripper, an indentation may be formed. According to the above-described illustrative embodiment, the punch 73 can easily be removed, after processing, from the nozzle plate 39 since only the tapered part 39*a* is pushed in with respect to the nozzle plate 39. Further, the warp of the nozzle plate 39 caused by the press working is relatively small. Therefore, according to the illustrative embodiment, the processing can be executed without using the stripper 80. Therefore, in order to prevent the occurrence of the indentation on the nozzle plate 39, it is preferable not to provide the stripper 80.

As described above, according to the illustrative embodiment, the multiple convex parts 50 protruded from the ink ejection surface 39*a* of the nozzle plate 39 are formed by the press working performed for the surface opposite to the ink ejection surface 39*a*. Further, it is possible to form the convex parts 50 which are largely protruded from the ink ejection surface 39*a* at areas relatively close to the nozzles 44 by largely deforming the metallic nozzle plate 39 by the press working. Furthermore, since the nozzle plate 39 is made of metallic material, plastic deformation of the metallic material is occurred by the press working, the shape of the convex parts 50 is maintained after the press working.

It is noted that the nozzle plate 39 is a metallic rolled member produced by the rolling process. Generally, the rolled member has an anisotropic property in its material structure since the rolled member is extended in its rolling direction, and the crystal grains are also extended in the rolling direction. Therefore, when the punch 73 is press-contacted on the metallic nozzle plate 39 and the convex part 50 is formed, deformation in the crystal grain boundary occurs easier in a direction orthogonal to the rolling direction than in the rolling direction. As a result, the deformation area is smaller in the direction orthogonal to the rolling direction. Thus, even though the cylindrical punch 73 is used, the convex part 50 formed on the nozzle plate 39 has an oval shape which is longer in the rolling direction as shown in FIGS. 3 and 5.

When the convex part 50 and the nozzle 44 are arranged in the rolling direction, when the metallic member constituting the nozzle plate 39 is expanded in the rolling direction when the convex part 50 is formed by the press working, there is a possibility that a portion of the nozzle plate 30 at which the nozzle 44 is formed is also deformed and the shape of the nozzle nay be changed or position of the nozzle may be changed. Therefore, it is preferable that the arrangement direction of the nozzles 44 (i.e., the conveying direction) is along the rolling direction of the nozzle plate 39. With such a configuration, the lines of the nozzles 44 (i.e., the nozzle arrays) and the lines of the convex parts 50 are aligned with the direction orthogonal to the rolling direction of the nozzle plate 39. Accordingly, when the press working is performed, even though the nozzle plate 39 deforms largely in the rolling direction, affection thereof to the portions of the nozzle plate 39 where the nozzles 44 are formed is small.

Regarding a relationship between the rolling direction and the convex parts 50, the following should also be noted. According to the illustrative embodiment, the multiple convex parts 50 are arranged in the two directions: the conveying direction (nozzle arrangement direction); and the scanning direction. Further, as shown in FIG. 5, the number of arranged nozzles 44 in the conveying direction is larger than the number of arranged nozzles 44 in the scanning direction. Since the convex parts 50 are parts of the nozzle plate 39 locally deformed to curve by the press processing, the nozzle plate 39 is easier to extend/shrink along the conveying direction in which the number of the arranged convex parts 50 are larger than that in the scanning direction. That is, the nozzle plate 39 is easier to warp in the conveying direction. On the other hand, when the nozzle plate 39 is the rolled member, it is less easy to extend/shrink in the rolling direction since it has been extended in the rolling direction. Therefore, in view of suppressing the warp of the nozzle plate 39 due to formation of the convex parts 50, it is preferable that the conveying direction, in which the number of arranged nozzles 44 is larger than that in the scanning direction, is along the rolling direction of the nozzle plate 39.

In the above description, an example in which the number of the convex parts 50 arranged in the conveying direction is larger than that in the scanning direction is described.

However, when the number of the convex parts 50 arranged in the scanning direction is larger than that in the conveying direction, the scanning direction is aligned to the rolling direction of the nozzle plate 39. Further, regarding the other plates 31-38 which also constitute the passage unit 23, by laminating the same such that the rolling direction of each of the metallic plates 31-38 coincides with the rolling direction of the nozzle plates 39, the warp suppressing effect in the nozzle plate 39 can be increased.

Protective Film Removal Process

Figure 6E:
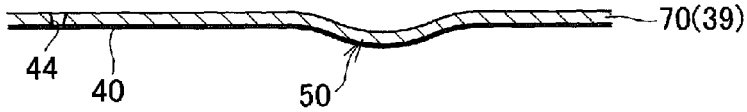

After the multiple nozzles 44 are formed on the nozzle plate 39, the protective film 71 is removed from the nozzle plate 39 as shown in FIG. 6E. When the protective film 71 is bonded to the nozzle plate 39 using the UV removal adhesive agent, by illuminating the UV light, the protective film 71 can be removed easily. Alternatively, depending on the type of the protective film 71, the protective film 71 can be removed by melting with use of an appropriate solvent.

Bonding Process

Figure 6F:
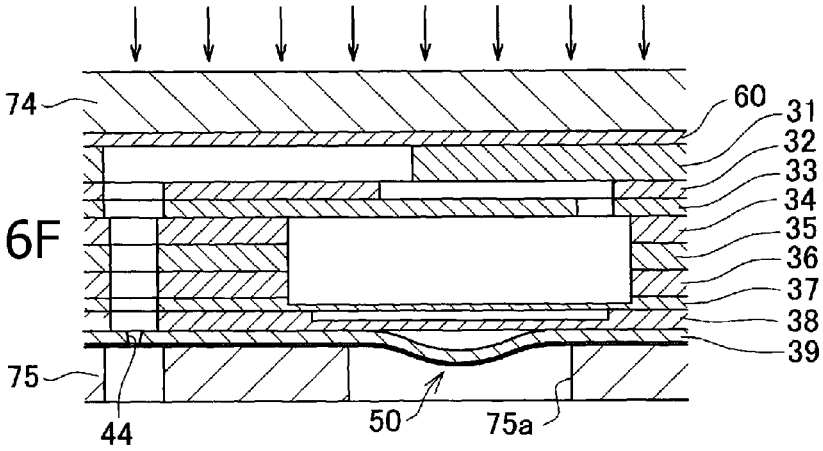

Next, the nozzle plate 39 on which the multiple convex parts 50 and the multiple nozzles 44 are formed, the other plates 31-38 constituting the passage unit 23, and the vibration plate 60 of the piezoelectric actuator 24 are bonded. According to the illustrative embodiment, as shown in FIG. 6F, the nozzle plate 39, the metallic plates 31-38 and the vibration plate 60 are laminated after thermosetting adhesive is applied to bonding surfaces thereof, and they are bonded by applying heat and pressure from up and down sides with use of the heater plates 74 and 75 as shown in FIG. 6F. It is noted that concave or hole-like relieve parts 75*a* are formed on the bottom side heater plate 75 at positions corresponding to the convex parts 50 so that the convex parts 50 will not be crashed by the heater plate 75. After the above-described bonding process, piezoelectric layers 64 and 65, which are formed in another process, are bonded on the vibration plate 65, thereby the piezoelectric actuator 24 is configured.

It is noted that the inkjet head 4 is an example of a liquid ejecting device in claims. The passage unit 23 is an example of a passage structure in the claims. The ink ejection surface 39*a*, which is the lower surface of the nozzle plate 39 is an example a liquid ejection surface in the claims. Further, the metallic plate 70 on which the multiple nozzles 44 are formed is an example of a metallic plate in the claims.

Hereinafter, modified embodiments which are modifications of the above-described illustrative embodiment will be described. In the following description on the modified embodiments, components and/or structures similar to those in the above-described embodiment are assigned with the same reference numbers and description thereof will be omitted for brevity.

1) The shape of the convex part 50 does not need to be limited to that of the illustrative embodiment described above. By changing the shape of the tip of the punch 73 and/or the die 72, the convex part 50 may have various shapes. Further, depending on characteristic of material of the plate 38 (e.g., ductility and the like), the deformation direction of the convex part 50 may not slant in a particular direction of the nozzle plate 39. In such a case, when the punch 73 having the cylindrical shape is used, the convex part 50 may have a substantially circular shape when viewed from the above.

Figure 7:
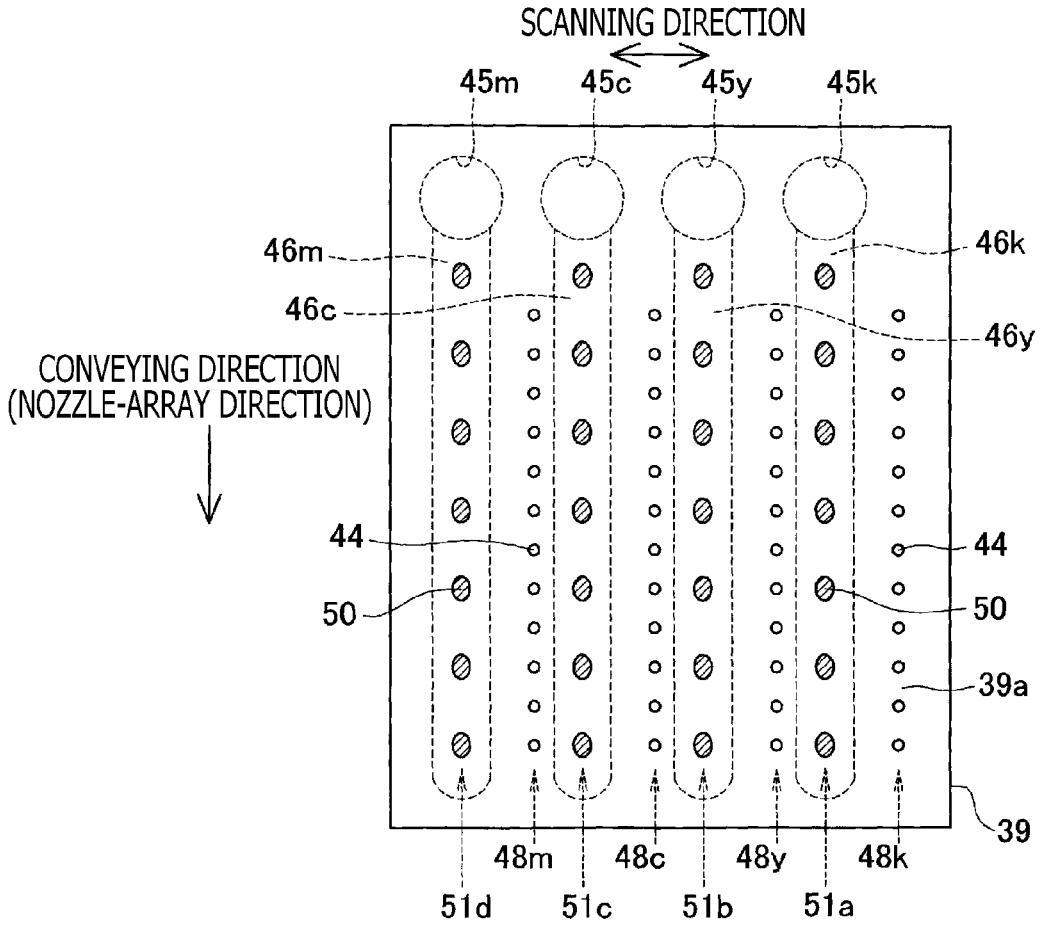
FIG. 7 is a bottom view of an inkjet head according to aspects of a modified embodiment of the disclosures.

2) Positions of the convex parts 50 on the nozzle plate do not need to be limited to those of the illustrative embodiment. According to the illustrative embodiment shown in FIG. 5, two lines 51 of convex parts 50 are aligned on both sides of each nozzle array 48. This can be modified such that, for at least a part of the nozzle arrays 48, the line 51 of the convex parts 50 is arranged only on one side of the nozzle array 48. In an example shown in FIG. 7, for the nozzle array 48*k*, only one line 51*a* of the convex parts 50 is provided and no line of the convex parts 50 is provided on the opposite side of the nozzle array 48.

Figure 8:
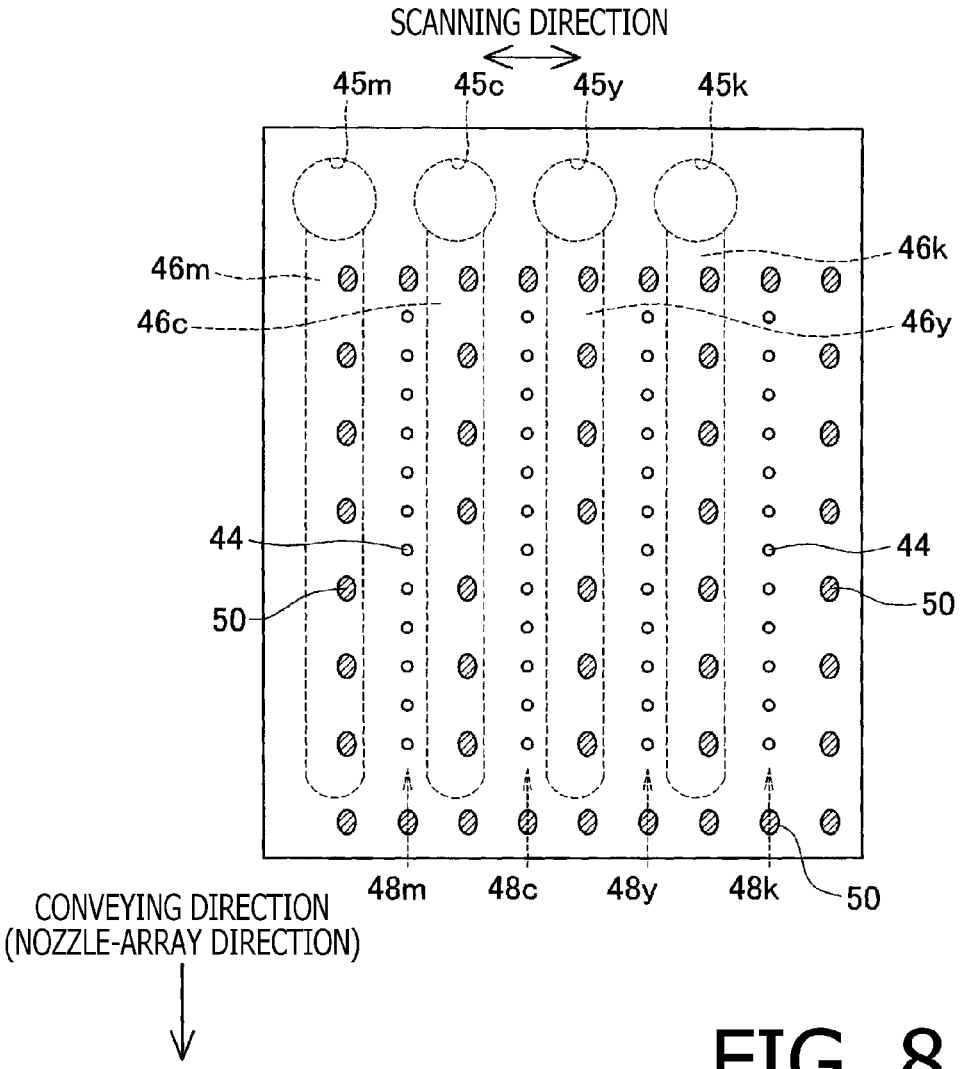
FIG. 8 is a bottom view of an inkjet head according to aspects of another modified embodiment of the disclosures.

According to another modification shown in FIG. 8, the convex parts 50 are arranged on an upstream side and/or a downstream side of the four lines of nozzle arrays 48 in the conveying direction. With this configuration, a protective effect around the nozzles 44 is enhanced.

3) The nozzle plate 39 may be configured to have thin parts at which the thickness of the nozzle plate 39 is partially decreased, and the convex parts 50 are formed by applying the press working to the think parts. Such a configuration will be further described referring to FIG. 9.

Figure 9:
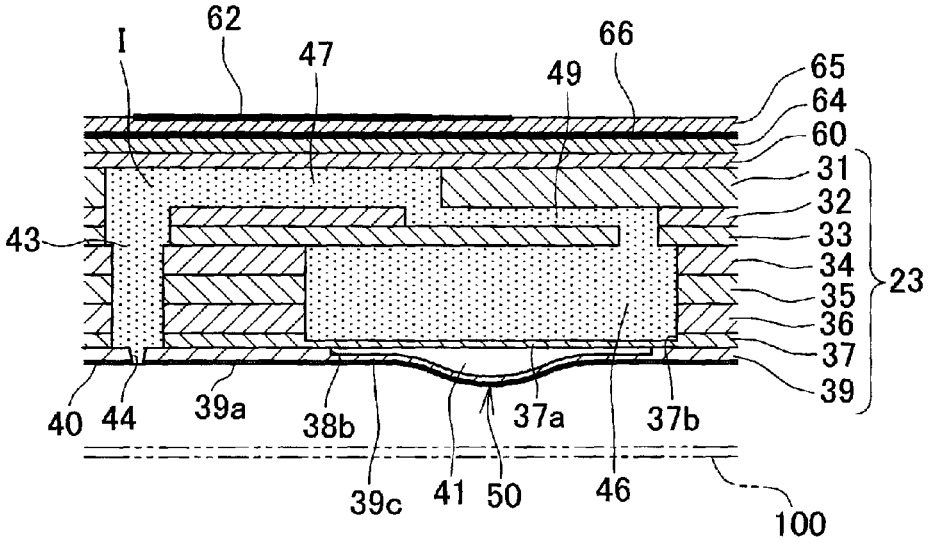
FIG. 9 is a cross-sectional view, which corresponds to FIG. 4, of the inkjet head according to the modified embodiment shown in FIG. 8.

In a modification shown in FIG. 9, the plate 38, which is included in the above-described illustrative embodiment (see FIG. 4), is omitted. Instead, according to the modification shown in FIG. 9, a structure which enabling deformation of a bottom wall part 37*a* of the manifold 46 is provided to the nozzle plate 39.

That is, as shown in FIG. 9, a portion of the upper surface of the nozzle plate 39 which corresponds to the bottom wall part 37*a* of the manifold 46 is provided with a concave part 39*b*. Further, on the nozzle plate 39, a thin part 39*c* is formed at a position corresponding to the manifold 46. With this configuration, a space 41 is defined between the bottom wall part 37*a* of the manifold 46 and the thin part 39*c* of the nozzle plate 39. With the above configuration, depending on pressure change inside the manifold 46, the bottom wall part 37*a* easily deforms.

The convex parts 50 of the nozzle plate 39 is formed by the press working at the thin parts 39*c*. By applying the press working to the thin parts 39*c*, deformation of the nozzle plate 39 by the press working will not expand outward exceeding a boundary between the thin part 39*c* and portion thicker than the thin part 39*c*. Accordingly, an area in which the deformation expands is restricted. Therefore, affection of deformation of the thin-walled parts 38*a* at the time of press working to portions where the nozzles 44 are formed is suppressed. It is noted that, in the modification shown in FIG. 9, the plates 34-37 on which the manifold 46 is formed is an example of a liquid chamber forming member set forth in the claims.

In the configuration shown in FIG. 9, the think part 39*c* of the nozzle plate 39 and the concave part 39*b* are provided to form the convex part 50 on the nozzle plate 39 by the press working, and to secure a space enabling the bottom wall part 37*a* of the manifold 46. It is noted that the thin part 39*c* may be formed only to form the convex part 50. In such a case, it is not necessary that the thin part 39*c* and the convex part 50 are arranged to a position corresponding to the manifold 46. That is, the thin part 39*c* and the convex part 50 can be arranged at any position regardless of the location of the manifold 46.

Figure 10:
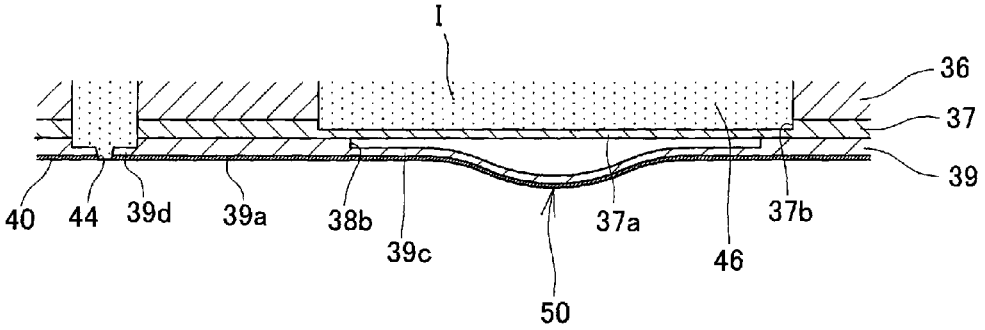
FIG. 10 is a cross-sectional view of the inkjet head at a portion around the nozzle plate according to the modified embodiment shown in FIG. 8.

As a further modification of the configuration shown in FIG. 9, a concave part may be formed on the nozzle plate 39 at a position where the nozzle 44 is formed, and a thin part 39*d* is also formed thereat as shown in FIG. 10. With this configuration, because of the thin thickness, piercing process by pressing, or formation of the nozzle 44 by laser machining can easily be executed. It is noted that the two types of thin parts 39*c* and 39*d* on the nozzle plate 39 can be formed at the same time by etching.

4) According to the illustrative embodiment, as shown in FIG. 6, after the multiple nozzles 44 are formed to the metallic plate 70, which will serve as the nozzle plate 39, the press working is applied to the metallic plate 70 to form the multiple convex parts 50. This order may be reversed. That is, the multiple convex parts 50 may be formed to the metallic plate 70 first, and then, the multiple nozzles 44 may be formed to the metallic plate 70.

5) The inkjet head 4 according to the illustrative embodiment is a so-called serial type head, which is configured to eject the ink drops as it moves together with the carriage 3 with respect to the printing sheet 100. It is noted that the aspects of the disclosure does not need to be limited to the serial head. For example, the configuration according to the illustrative embodiment may be applied to a line type head which is fixedly provided inside a main body of the printer and is configured such that multiple nozzles are arranged in a width direction of the printing sheet 100.

The illustrative embodiment and its modifications described above are directed to the inkjet printer which ejects the ink drops to print an image and the like on the printing sheet. It is noted that the above configuration may also be applied to a liquid ejecting device which is used in other purposes other than printing of images. For example, the above-described configuration may be applied to a liquid ejecting device configured to eject conductive liquid onto a circuit substrate to form a conductive pattern on the surface of the circuit substrate.

What is claimed is:

1. A liquid ejecting device, comprising a fluid passage structure formed with multiple nozzles arranged in a particular nozzle arrangement direction and multiple passages respectively communicating with the multiple nozzles, the fluid passage structure comprising:

a metallic nozzle plate formed with the multiple nozzles arranged in a nozzle arrangement direction, a planar liquid ejection surface on the metallic nozzle plate;

multiple ejection openings extending through the liquid ejection surface, the multiple ejection openings respectively corresponding to the multiple nozzles;

multiple convex parts protruding from the liquid ejection surface, each of the convex parts having an apex with a rounded shape, the multiple convex parts being arranged along the nozzle arrangement direction, beside the multiple ejection openings, respectively, and wherein the multiple convex parts are formed by press working applied to the nozzle plate from a side opposite to the liquid ejection surface.

2. The liquid ejecting device according to claim 1, wherein the nozzle plate is made of a rolled member formed by a rolling process, and wherein the multiple nozzles are arranged along a rolling direction of the rolled member.

3. The liquid ejecting device according to claim 1, wherein the nozzle plate is made of a rolled member formed by a rolling process, wherein the multiple convex parts are arranged along the nozzle arrangement direction and a direction orthogonal to the nozzle arrangement direction, wherein an arranged number of the multiple convex parts in the nozzle arrangement direction and an arranged number of the multiple convex parts in the direction orthogonal to the nozzle arrangement direction are different, and wherein one of the nozzle arrangement direction and the direction orthogonal to the nozzle arrangement direction in which the arranged number of the multiple convex parts is larger extends along the rolling direction of the rolled member.

4. The liquid ejecting device according to claim 1, wherein the nozzle plate has thin parts which are parts of the nozzle plate formed to be thin, and wherein the multiple convex parts are formed by applying the press working at the thin parts.

5. The liquid ejecting device according to claim 4, wherein concave parts are formed on a surface of the nozzle plate opposite to the liquid ejection surface, the portions of the nozzle plate formed to be concave parts being the thin parts, wherein the passage structure has a liquid chamber forming member formed with a common liquid chamber communicating with the multiple nozzles, wherein the surface of the nozzle plate opposite to the liquid ejection surface is arranged to contact one wall of the liquid chamber forming member partitioning the common liquid chamber, and wherein a space is formed between the one wall of the liquid chamber forming member and the thin part of the nozzle plate.

6. The liquid ejecting device according to claim 1, the multiple convex parts are configured to prevent a printing sheet from contacting the ejection openings.

7. The liquid ejecting device according to claim 6, wherein each of the multiple convex parts extends approximately 100 μm from the liquid ejection surface.

8. The liquid ejecting device according to claim 1, wherein:

the multiple nozzles are arranged in a plurality of lines extending in the nozzle arrangement direction, the multiple convex parts are arranged in a plurality of lines extending in the nozzle arrangement direction; and each of the lines of the multiple convex parts alternates with the lines of the multiple nozzles.

9. The liquid ejecting device according to claim 8, wherein the lines of the multiple convex parts and the lines of the multiple nozzles are arranged such that each line of the multiple nozzles has a single line of the multiple convex parts on either side thereof.

10. The liquid ejecting device according to claim 1, further comprising a second plate adjacent the nozzle plate, the second plate having concave parts that define corresponding thin-walled parts, wherein the convex parts are positioned opposite the thin-walled parts.

* * * * *